US009303296B2

(12) United States Patent
Ohe et al.

(10) Patent No.: US 9,303,296 B2
(45) **Date of Patent: *Apr. 5, 2016**

(54) HIGH-STRENGTH STAINLESS STEEL FOR OIL WELL AND HIGH-STRENGTH STAINLESS STEEL PIPE FOR OIL WELL

(75) Inventors: Taro Ohe, Osaka (JP); Hisashi Amaya, Kyoto (JP); Hideki Takabe, Osaka (JP); Kunio Kondo, Sanda (JP); Yohei Otome, Wakayama (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/607,957

(22) Filed: Sep. 10, 2012

(65) Prior Publication Data

US 2012/0328897 A1 Dec. 27, 2012

Related U.S. Application Data

(63) Continuation of application No. PCT/JP2011/060062, filed on Apr. 25, 2011.

(30) Foreign Application Priority Data

Apr. 28, 2010 (JP) ..... 2010-103249

(51) Int. Cl.
*C21D 8/10* (2006.01)
*C22C 38/42* (2006.01)
*C22C 38/44* (2006.01)

(52) U.S. Cl.
CPC *C21D 8/10* (2013.01); *C21D 8/105* (2013.01); *C22C 38/42* (2013.01); *C22C 38/44* (2013.01); *C21D 2211/005* (2013.01); *C21D 2211/008* (2013.01); *Y10T 428/12292* (2015.01)

(58) Field of Classification Search
CPC ..... C22C 38/06; C22C 38/08; C22C 38/12–38/28; C22C 38/32; C22C 38/38; C22C 38/40–38/50; C22C 38/54; C21D 8/10; C21D 8/105; C21D 2211/005; C21D 2211/008; Y10T 428/12292
USPC ..... 420/34, 40, 41, 60, 61, 67–70; 148/320, 148/325
See application file for complete search history.

(56) References Cited

U.S. PATENT DOCUMENTS

2006/0243354 A1* 11/2006 Kimura et al. ..... 148/592
2007/0074793 A1* 4/2007 Kimura ..... C21D 1/25 148/592

FOREIGN PATENT DOCUMENTS

| | | | |
|---|---|---|---|
| CA | 2717104 | A1 * | 10/2009 |
| CA | 2733649 | | 5/2010 |
| JP | 2002-004009 | | 1/2002 |
| JP | 2005-336595 | | 12/2005 |
| JP | 2005-336599 | | 12/2005 |
| JP | 2006-016637 | | 1/2006 |
| JP | 2006-307287 | | 11/2006 |
| JP | 2007-169776 | | 7/2007 |
| JP | 2007-332431 | | 12/2007 |
| JP | 2007-332442 | | 12/2007 |

* cited by examiner

*Primary Examiner* — Jessee Roe
*Assistant Examiner* — Caitlin Kiechle
(74) *Attorney, Agent, or Firm* — Clark & Brody

(57) ABSTRACT

A high-strength stainless steel for oil well having corrosion resistance excellent in a high-temperature environment, having excellent SSC resistance at normal temperature, and having better workability than 13% Cr steels has a chemical composition containing, by mass percent, C: at most 0.05%, Si: at most 1.0%, Mn: at most 0.3%, P: at most 0.05%, S: less than 0.002%, Cr: over 16% and at most 18%, Mo: 1.5 to 3.0%, Cu: 1.0 to 3.5%, Ni: 3.5 to 6.5%, Al: 0.001 to 0.1%, N: at most 0.025%, and O: at most 0.01%, the balance being Fe and impurities, a microstructure containing a martensite phase, 10 to 48.5%, by volume ratio, of a ferrite phase and at most 10%, by volume ratio, of a retained austenite phase, yield strength of at least 758 MPa and uniform elongation of at least 10%.

8 Claims, No Drawings

HIGH-STRENGTH STAINLESS STEEL FOR OIL WELL AND HIGH-STRENGTH STAINLESS STEEL PIPE FOR OIL WELL

TECHNICAL FIELD

The present invention relates to a stainless steel for oil well and a stainless steel pipe for oil well and, more particularly, to a stainless steel for oil well and a stainless steel pipe for oil well used in high-temperature oil well environments and gas well environments (hereinafter, referred to as high-temperature environments).

BACKGROUND ART

In this description, an oil well and a gas well are collectively referred to simply as "an oil well." Therefore, in this description, "a stainless steel for oil well" includes a stainless steel for oil well and a stainless steel for gas well. "A stainless steel pipe for oil well" includes a stainless steel pipe for oil well and a stainless steel pipe for gas well. In this description, "high temperature" refers to temperature of at least 150° C. And in this description, "%" related to elements refers to "percent by mass" unless otherwise specified.

Recent years have seen advances in the development of deep oil wells. Deep oil wells have high-temperature environments. High-temperature environments contain carbon dioxide gas or both carbon dioxide gas and hydrogen sulfide gas. These gases are corrosive gases.

Conventional oil-well environments contain carbon dioxide gas ($CO_2$) and chloride ions ($Cl^-$). For this reason, in conventional oil-well environments, martensitic stainless steels having an excellent carbon dioxide corrosion resistance and containing 13% Cr (hereinafter, referred to as 13% Cr steels) is used.

However, steels for oil well used in the above-described deep oil wells are required to have higher strength and higher corrosion resistance than 13% Cr steels. Dual-phase stainless steels have high Cr contents and have higher strength and higher corrosion resistance than 13% Cr steels. Dual-phase stainless steels are, for example, 22% Cr steels having a Cr content of 22% and 25% Cr steels having a Cr content of 25%. However, dual-phase stainless steels are expensive.

JP2002-4009 (Patent Document 1), JP2005-336595 (Patent Document 2), JP2006-16637 (Patent Document 3), JP2007-332442 (Patent Document 4), JP2006-307287 (Patent Document 5), JP2007-169776 (Patent Document 6) and JP2007-332431 (Patent Document 7) propose other steels which have higher strength and higher corrosion resistance than 13% Cr steels and are different from the above-described dual-phase stainless steels. The stainless steels disclosed in these documents contain 15 to 18% of Cr.

Specifically, Patent Document 1 (JP2002-4009) proposes a high-strength martensitic stainless steel for oil well having yield strength of at least 860 MPa and having carbon dioxide gas corrosion resistance in 150° C. environments. The stainless steel described herein contains Cr: 11.0 to 17.0% and Ni: 2.0 to 7.0% and further has a chemical composition satisfying $Cr+No+0.3Si-40C-10N-Ni-0.3Mn \leq 10$. The martensitic stainless steel described herein further has a tempered martensite structure containing at most 10% of retained austenite.

Patent Document 2 (JP2005-336595) proposes a stainless steel pipe having high strength and having carbon dioxide gas corrosion resistance in a 230° C. environment. The chemical composition of the stainless steel pipe described herein contains Cr: 15.5 to 18%, Ni: 1.5 to 5%, and Mo: 1 to 3.5%, satisfies $Cr+0.65Ni+0.6Mo+0.55Cu-20C \geq 19.5$, and satisfies $Cr+No+0.3Si-43.5C-0.4Mn-Ni-0.3Cu-9N \geq 11.5$. The microstructure of the stainless steel pipe described herein contains 10 to 60% of a ferrite phase and at most 30% of an austenite phase, and the balance is a martensite phase.

Patent Document 3 (JP2006-16637) proposes a stainless steel pipe having high strength and having carbon dioxide gas corrosion resistance in environments of over 170° C. The chemical composition of the stainless steel pipe described herein contains, by mass percent, Cr: 15.5 to 18.5%, Ni: 1.5 to 5%, satisfies $Cr+0.65Ni+0.6Mo+0.55Cu-20C \geq 18.0$, and satisfies $Cr+Mo+0.3Si-43.5C-0.4\ Mn-Ni-0.3Cu-9N \geq 11.5$. The microstructure of the stainless steel pipe described herein may contain an austenite phase or need not contain an austenite phase.

Patent Document 4 (JP2007-332442) proposes a stainless steel pipe having high strength of at least 965 MPa and having carbon dioxide gas corrosion resistance in environments of over 170° C. The chemical composition of the stainless steel pipe described herein contains, by mass percent, Cr: 14.0 to 18.0%, Ni: 5.0 to 8.0%, Mo: 1.5 to 3.5%, and Cu: 0.5 to 3.5%, and satisfies $Cr+2Ni+1.1Mo+0.7Cu \leq 32.5$. The microstructure of the stainless steel pipe described herein contains 3 to 15% of an austenite phase, and the balance is a martensite phase.

Patent Document 5 (JP2006-307287), Patent Document 6 (JP2007-169776) and Patent Document 7 (JP2007-332431) disclose stainless steel pipes containing, by mass percent, higher than 15% of Cr. The stainless steel pipes of these documents are expanded after being buried in oil wells. In order to increase expandability, the stainless steels of these documents have high austenite ratios. Specifically, the austenite ratios of the stainless steels of these documents exceed 20%. Or the ratio of austenite to tempered martensite is at least 0.25. The yield strength of the stainless steels of these documents is in many cases at most 750 MPa.

As described above, the stainless steels disclosed in Patent Documents 1 to 7 contain Cr in amounts larger than 13% and contains alloying elements, such as Ni, Mo, and Cu. For this reason, the stainless steels have carbon dioxide gas corrosion resistance in high-temperature environments.

DISCLOSURE OF THE INVENTION

However, the stainless steels disclosed in Patent Documents 1 to 7 above may sometimes develop cracks when stress is applied thereto in high-temperature environments. The well depth of deep oil wells is large. For this reason, the length and weight of oil well pipes used in high-temperature environments of deep oil wells increase. Therefore, the stainless steels for deep oil well are required to have high strength; specifically, they are required to have proof stress of at least 758 MPa. In this description, "proof stress" refers to 0.2% offset yield strength. Proof stress of at least 758 MPa corresponds to at least a 110-ksi class (equivalent to a yield stress range of 758 to 862 MPa).

Furthermore, the stainless steels used in high-temperature environments of deep oil wells are required to have excellent corrosion resistance at high temperature. In this description, "to be excellent in corrosion resistance" means that the corrosion rate of a stainless steel in high-temperature environments is less than 0.1 $g/(m^2 \cdot hr)$ and that the stainless steel is excellent in stress corrosion cracking resistance. Hereinafter, stress corrosion cracking is referred to as "SCC."

Furthermore, the stainless steels used in high-temperature environments of deep oil wells are required to have excellent sulfide stress corrosion cracking resistance at normal temperature. Hereinafter, sulfide stress corrosion cracking is referred to as "SSC". Fluids (crude oil or gas) produced in oil wells in high-temperature environments flow in oil-well pipes. When the production of a fluid is stopped for some cause, the fluid temperature in an oil-well pipe arranged near the earth's surface drops to normal temperature. SSC may occur in the oil-well pipe in contact with a fluid having a normal temperature. Therefore, stainless steels for oil well are required to have not only SCC resistance at high temperature, but also SSC resistance at normal temperature.

Furthermore, end portions of an oil-well pipe are subjected to threading for the joining to other oil-well pipes. Threading expands or reduces pipe ends of oil-well pipes. Therefore, stainless steel pipes for oil well are required to have excellent workability. The workability of conventional 13% Cr steels is generally low and the working of pipe ends is difficult.

In view of the above-described problems, the object of the present invention is to provide a high-strength stainless steel for oil well having the following properties:

Excellent corrosion resistance in high-temperature environments;

Excellent SSC resistance at normal temperature;

Yield stress of at least 758 MPa;

Better Excellent workability than 13% Cr steels.

The high-strength stainless steel according to the present invention has a chemical composition containing, by mass percent, C: at most 0.05%, Si: at most 1.0%, Mn: at most 0.3%, P: at most 0.05%, S: less than 0.002%, Cr: over 16% and at most 18%, Mo: 1.5 to 3.0%, Cu: 1.0 to 3.5%, Ni: 3.5 to 6.5%, Al: 0.001 to 0.1%, N: at most 0.025%, and O: at most 0.01%, the balance being Fe and impurities. The high-strength stainless steel has a microstructure containing a martensite phase, 10 to 48.5%, by volume ratio, of a ferrite phase and at most 10%, by volume ratio, of a retained austenite phase. The high-strength stainless steel has yield strength of at least 758 MPa and uniform elongation of at least 10%. "Yield strength" herein refers to "proof stress" and more specifically, it refers to 0.2% offset yield strength.

The above-described stainless steel may contain, in place of part of Fe, at least one selected from the group consisting of V: at most 0.30%, Nb: at most 0.30%, Ti: at most 0.30%, and Zr: at most 0.30%.

The above-described stainless steel may contain, in place of part of Fe, at least one selected from the group consisting of Ca: at most 0.005%, Mg: at most 0.005%, La: at most 0.005%, Ce: at most 0.005%, and B: at most 0.01%.

High-strength steel pipes according to the present invention are manufactured by using the above-described stainless steel.

BEST MODE FOR CARRYING OUT THE INVENTION

Hereinafter, an embodiment of the present invention will be described in detail.

As a result of studies, the present inventors obtained the findings as described below.

(1) Cr contents of at least 16% are effective in obtaining corrosion resistance in high-temperature environments and SSC resistance at normal temperature. Furthermore, that Mo, Ni and Cu are contained is effective in obtaining SCC resistance in high-temperature environments.

(2) When stainless steels contain at least 16% of Cr and contain Mo, Ni and Cu, the microstructures of stainless steels subjected to conventional quenching and tempering (tempering at temperature of at most the Act point) do not develop a martensite single phase. The metallurgical structure of the stainless steels contain a martensite phase, a ferrite phase and an austenite phase. If the volume ratio of a ferrite phase is 10 to 48.5%, the occurrence of cracks in high-temperature environments is suppressed and the corrosion resistance in high-temperature environments is improved.

(3) If the volume ratio of a ferrite phase is 10 to 48.5% and the volume ratio of an austenite phase is at most 10% in the microstructures of the above-described stainless steels, proof stress of at least 758 MPa is obtained. The volume ratio of an austenite phase becomes at most 10% when the Mn content and N content in steel are restrained to low levels.

(4) Excellent workability is obtained without dependence upon yield stress in a stainless steel having the chemical composition of (1) above, when the N content is at most 0.025%, the volume ratio of a ferrite phase is 10 to 48.5% and the volume ratio of an austenite phase is at most 10%. Specifically, uniform elongation of at least 10% is obtained.

On the basis of the above-described findings, the present inventors completed the present invention. Hereinafter, the present invention will be described.

Chemical Composition

The stainless steel for oil well according to the embodiment of the present invention has the following chemical composition.

C: at most 0.05%

Carbon (C) forms Cr carbides during tempering, thereby lowering the corrosion resistance against carbon dioxide gas of high temperature. Therefore, in the present invention, the lower the C content, the more preferable. The C content is at most 0.05%. The C content is preferably at most 0.03%, more preferably at most 0.01%.

Si: at most 1.0%

Silicon (Si) deoxidizes steel. However, if the Si content is too high, the amount of formed ferrite increases and hence proof stress decreases. For this reason, the Si content is at most 1.0%. A preferable Si content is at most 0.5%. If the Si content is at least 0.05%, Si acts especially effectively as a deoxidizer. However, even if the Si content is less than 0.05%, Si deoxidizes steel to some extent.

Mn: at most 0.3%

Manganese (Mn) deoxidizes and desulfurizes steel and increases hot workability. However, if the Mn content is too high, the corrosion resistance in high-temperature environments decreases. Mn is also an austenite former. For this reason, when a steel contains Ni and Cu, which are austenite formers, retained austenite increases if the Mn content is too high, with the result that proof stress decreases. Therefore, the Mn content is at most 0.3%. If the Mn content is at least 0.01%, the above-described effect (an increase in hot workability) is obtained especially effectively. However, even if the Mn content is less than 0.01%, the above-described effect is obtained to some extent. The Mn content is preferably at least 0.05% and less than 0.2%.

P: at most 0.05%

Phosphorus (P) is an impurity. P lowers the corrosion resistance against carbon dioxide gas of high temperature. Therefore, the lower the P content, the more preferable. The P content is at most 0.05%. The P content is preferably at most 0.025%, more preferably at most 0.015%.

S: less than 0.002%

Sulfur (S) is an impurity. S lowers hot workability. The stainless steel in this embodiment develops a dual-phase structure including a ferrite phase and an austenite phase during hot working. S remarkably lowers the hot workability of such a dual-phase structure. Therefore, the lower the S content, the more preferable. The S content is less than 0.002%. The S content is preferably at most 0.001%.

Cr: over 16% and at most 18%

Chromium (Cr) increases the corrosion resistance against carbon dioxide gas of high temperature. More specifically, Cr increases the SCC resistance in high-temperature carbon dioxide gas environments by the synergetic effect with other elements that increase corrosion resistance. However, Cr is a ferrite former. For this reason, if the Cr content is too high, the amount of ferrite in steel increases and hence the strength of steel decreases. Therefore, the Cr content is over 16% and at most 18%. The Cr content is preferably 16.5 to 17.8%.

Mo: 1.5 to 3.0%

As described above, when the production of fluids stops temporarily in oil wells, the temperature of the fluids in oil-well pipes drops. At this time, in general, the sulfide stress-corrosion cracking susceptibility of high-strength steel products becomes high. Molybdenum (Mo) improves sulfide stress-corrosion cracking susceptibility. However, Mo is a ferrite former. For this reason, if the Mo content is too high, the amount of ferrite in steel increases and hence the strength of steel decreases. Therefore, the Mo content is 1.5 to 3.0%. The Mo content is preferably 2.2 to 2.8%.

Cu: 1.0 to 3.5%

Copper (Cu) increases the strength of steel by aging precipitation. The stainless steel of the present invention causes aging precipitation of a Cu phase and hence has high strength. On the other hand, if the Cu content is too high, hot workability decreases. Therefore, the Cu content is 1.0 to 3.5%. The Cu content is preferably 1.5 to 3.2%, more preferably 2.3 to 3.0%.

Ni: 3.5 to 6.5%

Nickel is an austenite former. Ni stabilizes austenite at high temperature and increases the amount of martensite at normal temperature. For this reason, Ni increases the strength of steel. Furthermore, Ni increases the corrosion resistance in high-temperature environments. However, if the Ni content is too high, the Ms point decreases greatly and the amount of retained austenite in steel at normal temperature increases remarkably. A small amount of austenite increases the toughness of steel. However, a large amount of retained austenite lowers the strength of steel. Therefore, when the Ni content is high, a large amount of retained austenite is less apt to be formed if the Mn content and the N content are low.

However, if the Ni content exceeds 6.5%, then retained austenite is formed in such an amount as to lower strength even when the Mn content and the N content are lowered. Therefore, the Ni content is 3.5 to 6.5%. The Ni content is preferably 4.0 to 5.5%, more preferably 4.2 to 4.9%.

Al: 0.001 to 0.1%

Aluminum (Al) deoxidizes steel. However, if the Al content is too high, the amount of ferrite in steel increases and hence the strength of steel decreases. Therefore, the Al content is 0.001 to 0.1%.

O (Oxygen): at most 0.01%

Oxygen (O) is an impurity. O lowers the toughness and corrosion resistance of steel. Therefore, the lower the O content, the more preferable. The O content is at most 0.01%.

N: at most 0.025%

Nitrogen (N) increases the strength of steel. However, N lowers cold workability. If the N content is too high, the number of inclusions in steel increases and hence corrosion resistance decreases. In the present invention, in order to suppress a decrease in cold workability and corrosion resistance, the N content is at most 0.025%. The N content is preferably at most 0.020%, more preferably at most 0.018%. However, if the N content is suppressed excessively, the refining cost rises. Therefore, a lower limit to a preferable N content is at least 0.002%.

The balance of the chemical composition of the present invention is iron (Fe) and impurities.

The chemical composition of the stainless steel according to the present invention may further contain, in place of part of Fe, at least one selected from the group consisting of a plurality of elements below.

V: at most 0.30%

Nb: at most 0.30%

Ti: at most 0.30%

Zr: at most 0.30%

Vanadium (V), niobium (Nb), titanium (Ti), and zirconium (Zr) are all optional elements. These elements form carbides, thereby increasing the strength and toughness of steel. However, if the contents of these elements are too high, carbides coarsen and hence the toughness and corrosion resistance of steel decrease. Therefore, the V content, the Nb content, the Ti content, and the Zr content are each at most 0.30%. If the contents of these elements are at least 0.005%, the above-described effect is obtained especially effectively. However, even if the contents of these elements are less than 0.005%, the above-described effect is obtained to some extent.

The chemical composition of the stainless steel according to the present invention may further contain, in place of part of Fe, at least one selected from the group consisting of a plurality of elements below.

Ca: at most 0.005%

Mg: at most 0.005%

La: at most 0.005%

Ce: at most 0.005%

B: at most 0.01%

Calcium (Ca), magnesium (Mg), lanthanum (La), cerium (Ce), and boron (B) are all optional elements. The stainless steel of the present invention during hot working has a dual-phase structure of ferrite and austenite. For this reason, there is the possibility that flaws and defects are formed in the stainless steel by hot working. Ca, Mg, La, Ce, and B suppress the formation of flaws and defects during hot working.

On the other hand, if the contents of Ca, Mg, La, and Ce are too high, the number of inclusions in steel increases and hence the toughness and corrosion resistance of steel decrease. If the B content is too high, carboborides precipitate at the grain boundaries and the toughness of steel decreases. Therefore, the Ca content, the Mg content, the La content, and the Ce content are each at most 0.005%. The B content is at most 0.01%. If the contents of these elements are at least 0.0002%, the above-described effect is obtained especially effectively. However, even if the contents of these elements are less than 0.0002%, the above-described effect is obtained to some extent.

Metallurgical Structure

The metallurgical structure of the stainless steel according to the present invention contains 10 to 48.5%, by volume ratio, of a ferrite phase, at most 10%, by volume ratio, of a retained austenite phase, and a martensite phase.

Ferrite Phase: 10 to 48.5% by Volume Ratio

The stainless steel of the present invention has high contents of Cr and Mo, which are ferrite formers. On the other hand, the content of Ni, which is an austenite former, is suppressed to such an extent as not to cause an excessive drop of the Ms point. Therefore, the stainless steel of the present invention does not develop a martensitic single-phase structure at normal temperature and contains at least 10%, by volume ratio, of a ferrite phase at normal temperature. If the volume ratio of a ferrite phase in the metallurgical structure is too high, the strength of steel decreases. Therefore, the volume ratio of a ferrite phase is 10 to 48.5%.

The volume ratio of a ferrite phase is determined by the following method. A sample is taken from any position of a stainless steel. In the taken sample, the sample surface corresponding to the cross section of the stainless steel is ground. After the grinding, the ground sample surface is etched by using a mixed solution of aqua regia and glycerin. The area fraction of the ferrite phase on the etched surface is measured with the aid of an optical microscope (observation magnification: ×100) by the point counting method in accordance with JIS G0555. The measured area fraction is defined as the volume fraction of the ferrite phase.

Retained Austenite Phase: at Most 10% by Volume Ratio

A small amount of a retained austenite phase does not easily lower strength and remarkably increases the toughness of steel. However, if the volume ratio of a retained austenite phase is too high, the strength of steel decreases remarkably. Therefore, the volume ratio of a retained austenite phase is at most 10%. As described above, a retained austenite phase increases the toughness of steel and, therefore, it is an essential phase in the present invention. That is, the volume ratio of a retained austenite phase is higher than 0%. If the volume ratio of a retained austenite phase is at least 1.5%, the above-described effect is obtained especially effectively. However, even if the volume ratio of a retained austenite phase is less than 1.5%, the above-described effect is obtained to some extent.

The volume ratio of a retained austenite phase is determined by the X-ray diffraction method. Specifically, a sample is taken from any position of a stainless steel. The size of the sample is 15 mm×15 mm×2 mm. The X-ray intensity of each of the (200) plane and (211) plane of the ferrite phase (α phase), the (200) plane, (220) plane and (311) plane of the retained austenite phase (γ phase), is measured on this sample. And the integral intensity of each face is calculated. After the calculation, the volume ratio Vγ (%) is calculated by using Formula (1) for each of the combinations (a total of 6 groups) of each face of the α phase and each face of the γ phase. And the average value of the 6 groups of volume ratio Vγ is defined as the volume ratio (%) of the retained austenite.

$$v\gamma=100/(1+(I\gamma\times R\gamma)/(I\gamma\times R\alpha)) \quad (1)$$

where "Iα" and "Iγ" are integral intensities of the α phase and the γ phase. "Rα" and "Rγ" are scale factors of the α phase and the γ phase. The scale factor is a crystallographic theoretical calculation value based on a kind of material and a crystal face.

Martensite Phase:

In the metallurgical structure of the stainless steel of the present invention, portions other than the above-described ferrite phase and retained austenite phase are composed mainly of a tempered martensite phase. More specifically, the metallurgical structure of the stainless steel of the present invention contains at least 50%, by volume ratio, of a martensite phase. The volume ratio of the martensite phase is found by deducting the volume ratio of the ferrite phase and the volume ratio of the retained austenite phase, which are determined by the above-described method, from 100%. Incidentally, the metallurgical structure of the stainless steel of the present invention may contain carbides, nitrides, borides, a Cu phase and the like in addition to a ferrite phase, a retained austenite phase and a martensite phase.

Manufacturing Method

A method for manufacturing a seamless steel pipe will be described as an example of a manufacturing method of the stainless steel of the present invention.

A material having the above-described chemical composition is prepared. The material may be a slab (or a bloom) produced by the continuous casting process (including round continuous casting). Also, it is possible to use a billet produced by hot working an ingot produced by the ingot-making process. It is also possible to use a billet produced from the slab (or the bloom).

The prepared material is charged into a heating furnace or a soaking pit to be heated. Subsequently, the heated material is hot worked to produce a hollow shell. For example, the Mannesmann process is carried out as hot working. Specifically, the material is piercing-rolled by a piercing machine to produce a hollow shell. Subsequently, the hollow shell is further rolled on a mandrel mill or a sizing mill. Hot extrusion may be carried out as hot working or hot forging may be carried out.

It is preferred that during hot working, the reduction of area of the material be at least 50% when the material temperature is 850 to 1250° C. In the range of the chemical composition of the steel of the present invention, a microstructure including a martensite phase and a ferrite phase which is extended long (for example, on the order of 50 to 200 μm) in the rolling direction, is formed on the surface layer portion of the steel when the hot working is carried out so that the reduction of area of the material having the material temperature of 850 to 1250° C. is at least 50%. Because the ferrite phase is more apt to include Cr and other elements than martensite, the ferrite phase contributes effectively to the prevention of propagation of SCC at high temperature. As described above, in the case where the ferrite phase is extended long in the rolling direction, even if SCC occurs on the surface at high temperature, the probability that the SCC reaches the ferrite phase in the propagation process of the cracks to hereby cease, increases. For this reason, the SCC resistance at high temperature increases.

The hollow shell after hot working is cooled to normal temperature. The cooling method may be carried out by air cooling or water cooling. After the cooling, the hollow shell is quenched and tempered, whereby strength is adjusted so that the proof stress becomes at least 758 MPa. A preferable quenching temperature is at least the Ac3 transformation point. A preferable tempering temperature is at most the Ac1 transformation point. If the tempering temperature exceeds the Ac1 point, the volume ratio of retained austenite increases abruptly and strength decreases.

The high-strength stainless steel for oil well manufactured by the above-described process has proof stress of at least 758 MPa. The high-strength stainless steel for oil well has N contents of at most 0.025% and has 10 to 48.5% of a ferrite phase and at most 10% of a retained austenite phase and, therefore, this high-strength stainless steel for oil well has uniform elongation of at least 10%. Preferably, the high-strength stainless steel for oil well has uniform elongation of at least 12%. As described above, a high-strength stainless steel pipe for oil well is manufactured by using the high-strength stainless steel for oil well.

EXAMPLES

The steels A to J of the chemical compositions shown in Table 1 were melted and slabs (or blooms) were produced.

TABLE 1

| Steel | Chemical composition (unit: mass %, the balance are Fe and impurities) | | | | | | | | | | | | | | |
|---|---|---|---|---|---|---|---|---|---|---|---|---|---|---|---|
| No. | C | Si | Mn | P | S | Cu | Ni | Cr | Mo | V | Nb | Ti | Al | N | Ca |
| A | 0.020 | 0.31 | 0.17 | 0.013 | 0.0006 | 2.4 | 4.7 | 16.7 | 2.55 | 0.06 | — | — | 0.039 | 0.0107 | 0.0013 |
| B | 0.010 | 0.25 | 0.08 | 0.015 | 0.0007 | 2.4 | 4.5 | 17.0 | 2.68 | — | 0.003 | 0.006 | 0.049 | 0.0055 | — |
| C | 0.033 | 0.24 | 0.15 | 0.018 | 0.0005 | 2.5 | 4.9 | 17.4 | 1.94 | — | — | — | 0.050 | 0.0131 | — |
| D | 0.019 | 0.29 | 0.84 | 0.010 | 0.0011 | 2.6 | 4.9 | 15.6 | 2.60 | 0.07 | — | 0.008 | 0.026 | 0.0410 | — |
| E | 0.022 | 0.25 | 0.15 | 0.018 | 0.0010 | 1.5 | 5.9 | 16.5 | 2.60 | 0.07 | — | — | 0.028 | 0.0454 | — |
| F | 0.018 | 0.23 | 0.45 | 0.018 | 0.0008 | 0.75 | 6.0 | 14.8 | 1.90 | 0.07 | 0.006 | — | 0.012 | 0.0480 | — |
| G | 0.010 | 0.26 | 0.41 | 0.014 | 0.0005 | 0.18 | 5.4 | 12.1 | 1.94 | 0.06 | 0.004 | 0.102 | 0.034 | 0.0072 | — |
| H | 0.022 | 0.34 | 0.29 | 0.016 | 0.0008 | 1.9 | 4.8 | 17.3 | 2.51 | 0.12 | 0.15 | — | 0.041 | 0.0198 | 0.0038 |
| I | 0.007 | 0.26 | 0.22 | 0.014 | 0.0005 | 2.55 | 4.6 | 16.8 | 2.30 | 0.08 | — | 0.18 | 0.036 | 0.0152 | 0.0042 |
| J | 0.029 | 0.29 | 0.35 | 0.018 | 0.0010 | 3.00 | 6.2 | 16.5 | 1.20 | 0.08 | — | — | 0.052 | 0.0199 | — |

With reference to Table 1, the chemical compositions of the steels A to C and of the steels H and I were within the range of the present invention. On the other hand, the chemical compositions of the steels D to G and of the steel J were out of the range of the present invention. The steel G had the same chemical composition as conventional 13% Cr steels. The contents of oxygen (O) of the steels A to J were all within the range of the O content of the present invention (at most 0.01%).

Slabs (or Blooms) of each of the steels A to J were rolled on a blooming mill to produce round billets. The diameter of the round billets of each of the steels A to E and of the steels H to J was 191 mm. The outer surfaces of the round billets were machined and the diameter of the round billets was reduced to 187 mm. On the other hand, slabs (or blooms) of the steels F and G were rolled on the blooming mill to produce round billets having a diameter of 225 mm.

The round billets of the steels A to E and of the steels H to J were heated to 1230° C. in a heating furnace. After the heating, each of the round billets was piercing-rolled by a piercer and hollow shells having an outside diameter of 196 mm and a wall thickness of 21.2 mm were produced. The produced hollow shells were elongated on a mandrel mill. The elongated hollow shells were heated, and after the heating, the diameter of the hollow shells was reduced by a stretch reducer, whereby seamless steel pipes having an outside diameter of 88.9 mm and a wall thickness of 11.0 mm were manufactured.

Each of the round billets of the steels F and G was heated to 1240° C. After the heating, each of the round billets was piercing-rolled and hollow shells having an outside diameter of 228 mm and a wall thickness of 23.0 mm were produced. And as with the steels A to E, each of the hollow shells was elongated and the diameter thereof was reduced, whereby seamless steel pipes having an outside diameter of 177.8 mm and a wall thickness of 12.65 mm were manufactured.

After the reduction of the diameter, each of the seamless steel pipes of the steels A to J was cooled to normal temperature. And quenching and tempering of each of the seamless steel pipes were carried out, whereby the strength of each steel was adjusted. The quenching temperature was 980° C. and the soaking time for quenching was 20 minutes. The tempering temperature was 520 to 620° C., and the soaking time during tempering was 30 to 40 minutes. Incidentally, the Ac1 points of the steels A to C and of the steels H and I were 600 to 660° C., and the Ac3 points thereof were in the range of 760 to 820° C., whereas the Ac1 points of the steels D to G and of the steel J were 590 to 650° C. and the Ac3 points thereof were in the range of 700 to 750° C.

The following investigation was carried out on the seamless steel pipes of each of the steels A to J manufactured by the above-described processes.

Tensile Test

Round bar specimens (ϕ6.35 mm×GL 25.4 mm) in accordance with the provisions of API were taken from the seamless steel pipes of each of the steels A to J. The tension direction of the round bar specimens was the pipe axis direction of the seamless steel pipes. The tensile test was carried out on the prepared round bar specimens at normal temperature (25° C.) in accordance with the provisions of API. Proof stress (yield strength) YS (MPa), tensile strength TS (MPa), total elongation EL (%), and uniform elongation (%) were found from the results of the tensile test.

Observation of Metallurgical Structure

Samples for the observation of microstructure were taken from any position of the seamless steel pipes of each of the steels A to J. In the taken samples, the sample surface of a section perpendicular to the axis direction of each seamless steel pipe was ground. After the grinding, the ground sample surface was etched by using a mixed solution of aqua regia and glycerin. The area fraction of the ferrite phase on the etched surface was measured by the point counting method in accordance with JIS G0555. The measured area fraction was defined as the volume fraction of the ferrite phase.

Furthermore, the volume ratio of the retained austenite phase was determined by the above-described X-ray diffraction method. Moreover, on the basis of the volume ratio of the ferrite phase and volume ratio of the retained austenite phase, which had been found, the volume ratio of the martensite phase was found by the above-described method.

High-Temperature Corrosion Resistance Test

Four-point bending specimens were taken from the seamless steel pipes of each of the steels A to J. The length of the specimens was 75 mm, the width was 10 mm, and the thickness was 2 mm. A deflection by four-point bending was given to each specimen. At this time, the amount of deflection of each specimen was determined in accordance with ASTM G39 so that the stress given to each specimen became equal to the proof stress of the specimen.

An autoclave having a temperature of 175° C. and an autoclave having a temperature of 200° C., in each of which 30 atm of $CO_2$ and 0.01 atm of $H_2S$ were sealed under pressure, were prepared. Each specimen to which deflection had been applied was housed in each autoclave. And within each autoclave, each specimen was immersed in an aqueous solution of 25%, by wt %, of NaCl for a month. The NaCl aqueous solution was adjusted to pH 3.3 in the 175° C. autoclave and to pH 4.5 in the 200° C. autoclave.

After the immersion for a month, whether stress corrosion cracking (SCC) had occurred was investigated in each specimen. Specifically, the section of a portion in each specimen to which tensile stress was applied was observed under an optical microscope with ×100 field, and existence or nonexistence of cracks was determined. Furthermore, the weight of the specimens before and after the test was measured. The corrosion loss of each specimen was found on the basis of the amount of change in the measured weight. The corrosion rate (g/(m$^2$·h)) of each specimen was found on the basis of the corrosion loss.

SSC Resistance Test at Normal Temperature

Round bar specimens for NACE TM0177 METHOD A were taken from the seamless steel pipes of each of the steels A to J. The size of the specimens was ϕ6.35 mm×GL25.4 mm. Tensile stress was given in the axial direction of each specimen. At this time, the amount of deflection of each specimen was determined so that the stress given to each specimen became 90% of the proof stress (measured valued) of each specimen in accordance with NACE TM0177-2005.

Two test cells having normal temperature (25° C.) in which the test gases shown in Table 2 were sealed were prepared.

TABLE 2

| | Test gas | Test solution | Applied stress |
|---|---|---|---|
| Test cell 1 | $H_2S$ of 0.01 MPa + $CO_2$ of 0.09 MPa | NaCl of 0.5 wt % (pH = 3.0) | 90% of measured value of proof stress |
| Test cell 2 | $H_2S$ of 0.005 MPa + $CO_2$ of 0.095 MPa | NaCl of 0.5 wt % (pH = 3.0) | 90% of measured value of proof stress |

Each specimen to which deflection had been applied was housed in each of the test cells 1 and 2. And in each of the test cells, the specimen was immersed for a month in the NaCl aqueous solution shown in Table 2. After the immersion for a month, by using the same method as in the high-temperature corrosion resistance test, whether cracking (SSC) had occurred was investigated in each specimen.

Results of Investigation

Metallurgical Structure and Yield Stress

Table 3 shows the results of the observation of the metallurgical structure and the tensile test of each of the steels A to J.

TABLE 3

| Test No. | Steel | Quenching temp. (° C.) | Tempering temp. (° C.) | Amount of γ phase (%) | Amount of α phase (%) | Amount of M phase | YS(MPa) | TS(MPa) | EL(%) | U. EL(%) | Remarks |
|---|---|---|---|---|---|---|---|---|---|---|---|
| 1 | A | 980 | 550 | 3 | 41 | 56 | 903 | 984 | 30.5 | 13.6 | Inventive example |
| 2 | A | 980 | 520 | 3 | 35 | 62 | 966 | 1069 | 29.9 | 14.3 | Inventive example |
| 3 | A | 980 | 540 | 3 | 33 | 64 | 948 | 1029 | 29.9 | 13.3 | Inventive example |
| 4 | A | 980 | 560 | 3 | 40 | 57 | 896 | 981 | 29.9 | 13.4 | Inventive example |
| 5 | A | 980 | 580 | 3 | 38 | 59 | 870 | 960 | 30.1 | 13.8 | Inventive example |
| 6 | A | 980 | 600 | 4 | 38 | 58 | 815 | 936 | 29.9 | 14.0 | Inventive example |
| 7 | A | 980 | 620 | 7 | 40 | 53 | 767 | 922 | 29.7 | 13.7 | Inventive example |
| 8 | A | 980 | 670 | 20 | 40 | 40 | 578 | 865 | 29.5 | 13.5 | Comparative example |
| 9 | B | 980 | 575 | 4 | 38 | 58 | 893 | 937 | 28.1 | 12.8 | Inventive example |
| 10 | C | 980 | 620 | 2 | 25 | 73 | 851 | 923 | 28.6 | 13.1 | Inventive example |
| 11 | D | 980 | 600 | 12 | 40 | 48 | 530 | 851 | 29.8 | 13.3 | Comparative example |
| 12 | E | 980 | 520 | 11 | 32 | 57 | 553 | 853 | 29.2 | 13.4 | Comparative example |
| 13 | F | 960 | 690 | 26 | 22 | 52 | 524 | 713 | 26 | 13.6 | Comparative example |
| 51 | G | 900 | 520 | 0 | 0 | 100 | 874 | 931 | 24.6 | 7.2 | Conventional steel |
| 52 | G | 900 | 550 | 0 | 0 | 100 | 875 | 932 | 25.2 | 7.3 | Conventional steel |
| 53 | G | 900 | 590 | 0 | 0 | 100 | 818 | 853 | 27.2 | 8.5 | Conventional steel |
| 54 | G | 900 | 620 | 0 | 0 | 100 | 727 | 794 | 29.3 | 9.8 | Conventional steel |
| 60 | H | 980 | 550 | 7 | 35 | 58 | 985 | 1075 | 29.9 | 13.3 | Inventive example |
| 61 | H | 980 | 575 | 4 | 41 | 55 | 882 | 978 | 29.9 | 14.0 | Inventive example |
| 62 | H | 980 | 600 | 8 | 31 | 61 | 827 | 951 | 30.3 | 13.2 | Inventive example |
| 63 | I | 980 | 550 | 5 | 40 | 55 | 958 | 1061 | 29.9 | 12.9 | Inventive example |
| 64 | I | 980 | 575 | 7 | 40 | 53 | 868 | 958 | 30.3 | 13.6 | Inventive example |
| 65 | I | 980 | 600 | 5 | 36 | 59 | 813 | 937 | 28.7 | 13.5 | Inventive example |
| 66 | J | 950 | 550 | 14 | 41 | 45 | 744 | 923 | 30.3 | 13.6 | Comparative example |
| 67 | J | 950 | 575 | 16 | 37 | 47 | 675 | 909 | 28.7 | 13.8 | Comparative example |
| 68 | J | 950 | 600 | 15 | 43 | 42 | 634 | 916 | 29.9 | 14.1 | Comparative example |

In Table 3, "quenching temp." refers to the quenching temperature (° C.) reached when the specimen of each test No. was quenched. "Tempering temp." refers to the tempering temperature (° C.) reached when the specimen of each test No. was tempered. "Amount of γ phase" refers to the volume ratio (%) of the retained austenite phase of the specimen of each test No., "amount of a phase" refers to the volume ratio (%) of the ferrite phase, and "amount of M phase" refers to the volume ratio (%) of the martensite phase. In Table 3, "YS" denotes the proof stress (MPa) of the specimen of each test No. "TS" denotes the tensile strength (MPa) of the specimen of each test No., "EL" denotes total elongation (%), and "U. EL" denotes uniform elongation (%).

With reference to Table 3, the chemical compositions and metallurgical structures of test Nos. 1 to 7, 9, 10 and 60 to 65 were within the range of the present invention. For this reason, yield strength (proof stress) of at least 758 MPa and uniform elongation of at least 10% were obtained.

On the other hand, in test No. 8, the volume ratio of the retained austenite phase exceeded 10% and the volume ratio of the martensite was less than 50%, although the chemical composition was within the range of the present invention. For this reason, the yield strength of test No. 8 was less than 758 MPa. The tempering temperature of test No. 8 was 670° C., higher than the Ac1 point (approximately 630° C.). It seems that because of this, the amount of retained austenite increased and the amount of martensite decreased.

In test No. 11, the Cr content was less than the lower limit to this element of the present invention and furthermore, the contents of Mn and N, which are austenite formers, exceeded the upper limits to the contents of these elements of the present invention. For this reason, the yield strength was less than 758 MPa.

The N content of test No. 12 exceeded the upper limit to this element of the present invention. For this reason, the volume ratio of the retained austenite phase exceeded 10%. As a result of this, the yield strength was less than 758 MPa.

The Mn content and N content of test No. 13 exceeded the upper limits to the contents of these elements of the present invention. The Cu content and Cr content of test No. 13 were less than the lower limits to the contents of these elements of the present invention. Mn and N are austenite formers, and Cr is a ferrite former. Although the content of Cu, which is an austenite former, was less than the lower limit to the content of this element of the present invention, the N and Mn contents were excessive. Furthermore, the tempering temperature of test No. 13 was 690° C., higher than the Act point (approximately 600° C.). For this reason, the volume ratio of retained austenite exceeded 10% and the proof stress became less than 758 MPa.

The specimens of test Nos. 51 to 54 were taken from the steel G, which corresponded to a conventional 13% Cr steel. In these specimens, tempering was carried out in the various ranges of the tempering temperature (520° C. to 690° C.). However, in all of the specimens, uniform elongation was less than 10%. The specimens of test Nos. 66 to 68 were taken from the steel J, the Mn content exceeded the upper limit to the content of this element of the present invention and the Mo content was less than the lower limit to the content of this element of the present invention. In these specimens, the volume ratio of retained austenite exceeded 10% although tempering was carried out at 550 to 600° C. For this reason, the proof stress became less than 758 MPa and it was impossible to obtain sufficient strength.

Corrosion Resistance at High Temperature and SSC Resistance at Normal Temperature Table 4 shows the results of the corrosion resistance test at high temperature and SSC resistance test at normal temperature which were conducted on each of the steels A to J. However, the steels D to F (test Nos. 11 to 13) were excluded from the evaluation of the SSC resistance test, because the yield strength of the steels D to F (test Nos. 11 to 13) was less than 600 MPa.

In "High-temp. SCC and corrosion loss" of Table 4, "175° C." indicates the results of the above-described high-temperature corrosion resistance test at 175° C., and "200° C." indicates the results of the above-described high-temperature corrosion resistance test at 200° C. "Occurred" in the "Pitting" column indicates that the occurrence of SCC was made sure of, and "Not occurred" indicates that the occurrence of SCC was not made sure of.

In Table 4, "Test cell 1" in the "normal temperature SSC" column indicates the results of the test conducted in the test cell 1 of Table 2, "Test cell 2" indicates the results of the test conducted in the test cell 2 of Table 2. "Occurred" in "Test cell 1" and "Test cell 2" indicates that the occurrence of SSC was made sure of, and "Not occurred" indicates that the occurrence of SSC was not made sure of.

With reference to Table 4, in the specimens of test Nos. 1 to 10 and of test Nos. 60 to 65, neither SCC nor SSC occurred. Furthermore, the corrosion rate was less than 0.1 g/(m$^2$·h). On the other hand, in the specimens of test Nos. 51 to 54 corresponding to conventional 13 Cr steels, the occurrence of both SCC and SSC was made sure of. Furthermore, the corrosion rate at 175° C. was at least 0.1 g/(m$^2$·h). Since the specimens of test Nos. 66 to 68 were obtained from the steel J, the Mo content was less than the lower limit to the content of this element of the present invention. For this reason, in the specimens of test Nos. 66 to 68, SSC occurred although SCC did not occur.

The embodiment of the present invention has been described above. However, the above-described embodiment is only illustrative for carrying out the present invention. Therefore, the present invention is not limited to the above-described embodiment and can be carried out by appropriately modifying the above-described embodiment so long as such modifications do not depart from the gist of the present invention.

TABLE 4

| | | High-temp. SCC and corrosion loss | | | | | | |
|---|---|---|---|---|---|---|---|---|
| | | 175° C. | | 200° C. | | | | |
| | Steel | Corrosion rate | | Corrosion rate | | Normal-temp. SSC | | |
| Test No. | No. | (g/(m$^2$ · h)) | Pitting | (g/(m$^2$ · h)) | Pitting | Test cell 1 | Test cell 2 | Remarks |
| 1 | A | 0.011 | Not occurred | 0.012 | Not occurred | Not occurred | Not occurred | Inventive example |
| 2 | A | 0.011 | Not occurred | 0.012 | Not occurred | Not occurred | Not occurred | Inventive example |
| 3 | A | 0.011 | Not occurred | 0.012 | Not occurred | Not occurred | Not occurred | Inventive example |
| 4 | A | 0.009 | Not occurred | 0.011 | Not occurred | Not occurred | Not occurred | Inventive example |
| 5 | A | 0.011 | Not occurred | 0.013 | Not occurred | Not occurred | Not occurred | Inventive example |
| 6 | A | 0.010 | Not occurred | 0.011 | Not occurred | Not occurred | Not occurred | Inventive example |
| 7 | A | 0.010 | Not occurred | 0.012 | Not occurred | Not occurred | Not occurred | Inventive example |
| 8 | A | 0.012 | Not occurred | 0.013 | Not occurred | Not occurred | Not occurred | Comparative example |
| 9 | B | 0.012 | Not occurred | 0.013 | Not occurred | Not occurred | Not occurred | Inventive example |
| 10 | C | 0.013 | Not occurred | 0.014 | Not occurred | Not occurred | Not occurred | Inventive example |
| 51 | G | 0.240 | Occurred | 0.092 | Occurred | Occurred | Occurred | Conventional steel |
| 52 | G | 0.220 | Occurred | 0.094 | Occurred | Occurred | Occurred | Conventional steel |
| 53 | G | 0.230 | Occurred | 0.088 | Occurred | Occurred | Occurred | Conventional steel |
| 54 | G | 0.250 | Occurred | 0.090 | Occurred | Occurred | Occurred | Conventional steel |
| 60 | H | 0.009 | Not occurred | 0.011 | Not occurred | Not occurred | Not occurred | Inventive example |
| 61 | H | 0.010 | Not occurred | 0.010 | Not occurred | Not occurred | Not occurred | Inventive example |
| 62 | H | 0.010 | Not occurred | 0.011 | Not occurred | Not occurred | Not occurred | Inventive example |
| 63 | I | 0.011 | Not occurred | 0.012 | Not occurred | Not occurred | Not occurred | Inventive example |
| 64 | I | 0.009 | Not occurred | 0.011 | Not occurred | Not occurred | Not occurred | Inventive example |
| 65 | I | 0.009 | Not occurred | 0.010 | Not occurred | Not occurred | Not occurred | Inventive example |
| 66 | J | 0.011 | Not occurred | 0.011 | Not occurred | Occurred | Occurred | Comparative example |
| 67 | J | 0.011 | Not occurred | 0.013 | Not occurred | Occurred | Occurred | Comparative example |
| 68 | J | 0.010 | Not occurred | 0.011 | Not occurred | Occurred | Occurred | Comparative example |

The invention claimed is:

1. A high-strength stainless steel for oil well, having a chemical composition consisting of, by mass percent, C: at most 0.05%, Si: at most 1.0%, Mn: at most 0.17%, P: at most 0.05%, S: less than 0.002%, Cr: over 16% and at most 18%, Mo: 1.5 to 3.0%, Cu: 1.0 to 3.5%, Ni: 3.5 to 6.5%, Al: 0.001 to 0.1%, N: at most 0.025%, and O: at most 0.01%, the balance being Fe and impurities, a microstructure comprising a martensite phase, 10 to 48.5%, by volume ratio, of a ferrite phase and at most 10%, by volume ratio, of a retained austenite phase, yield strength of at least 758 MPa and uniform elongation of at least 10%.

2. A high-strength stainless steel pipe for oil well manufactured using the stainless steel according to claim 1.

3. A high-strength stainless steel for oil well, having a chemical composition consisting of, by mass percent, C: at most 0.05%, Si: at most 1.0%, Mn: at most 0.17%, P: at most 0.05%, S: less than 0.002%, Cr: over 16% and at most 18%, Mo: 1.5 to 3.0%, Cu: 1.0 to 3.5%, Ni: 3.5 to 6.5%, Al: 0.001 to 0.1%, N: at most 0.025%, and O: at most 0.01, and at least one selected from the group consisting of V: at most 0.30%, Nb: at most 0.30%, Ti: at most 0.30%, and Zr: at most 0.30%, the balance being Fe and impurities, a microstructure comprising a martensite phase, 10 to 48.5%, by volume ratio, of a ferrite phase and at most 10%, by volume ratio, of a retained austenite phase, yield strength of at least 758 MPa and uniform elongation of at least 10%.

4. A high-strength stainless steel pipe for oil well manufactured using the stainless steel according to claim 3.

5. A high-strength stainless steel for oil well, having a chemical composition consisting of, by mass percent, C: at most 0.05%, Si: at most 1.0%, Mn: at most 0.17%, P: at most 0.05%, S: less than 0.002%, Cr: over 16% and at most 18%, Mo: 1.5 to 3.0%, Cu: 1.0 to 3.5%, Ni: 3.5 to 6.5%, Al: 0.001 to 0.1%, N: at most 0.025%, and O: at most 0.01, and at least one selected from the group consisting of Ca: at most 0.005%, Mg: at most 0.005%, and B: at most 0.01%, the balance being Fe and impurities, a microstructure comprising a martensite phase, 10 to 48.5%, by volume ratio, of a ferrite phase and at most 10%, by volume ratio, of a retained austenite phase, yield strength of at least 758 MPa and uniform elongation of at least 10%.

6. A high-strength stainless steel pipe for oil well manufactured using the stainless steel according to claim 5.

7. A high-strength stainless steel for oil well, having a chemical composition consisting of, by mass percent, C: at most 0.05%, Si: at most 1.0%, Mn: at most 0.17%, P: at most 0.05%, S: less than 0.002%, Cr: over 16% and at most 18%, Mo: 1.5 to 3.0%, Cu: 1.0 to 3.5%, Ni: 3.5 to 6.5%, Al: 0.001 to 0.1%, N: at most 0.025%, and O: at most 0.01, at least one selected from the group consisting of V: at most 0.30%, Nb: at most 0.30%, Ti: at most 0.30%, and Zr: at most 0.30%, and at least one selected from the group consisting of Ca: at most 0.005%, Mg: at most 0.005%, and B: at most 0.01%%, the balance being Fe and impurities, a microstructure comprising a martensite phase, 10 to 48.5%, by volume ratio, of a ferrite phase and at most 10%, by volume ratio, of a retained austenite phase, yield strength of at least 758 MPa and uniform elongation of at least 10%.

8. A high-strength stainless steel pipe for oil well manufactured using the stainless steel according to claim 7.

* * * * *